United States Patent [19]

Haflinger

[11] 4,032,815

[45] June 28, 1977

[54] COLLIMATED BEAM ELECTRON GUN SYSTEM FOR SHAPED BEAM CATHODE RAY TUBE

[75] Inventor: Dan Joseph Haflinger, Rancho Santa Fe, Calif.

[73] Assignee: Stromberg Datagraphix Inc., San Diego, Calif.

[22] Filed: Nov. 4, 1975

[21] Appl. No.: 628,805

[52] U.S. Cl. ..... 315/14; 315/365; 313/446

[51] Int. Cl.[2] ..... H01J 29/46; H01J 29/56

[58] Field of Search ..... 313/447, 448, 449, 452; 315/365, 14, 446

[56] References Cited

UNITED STATES PATENTS

| | | | |
|---|---|---|---|
| 3,421,044 | 1/1969 | Murdock et al. | 315/14 |
| 3,473,077 | 10/1969 | Corpew | 315/365 |
| 3,887,830 | 6/1975 | Spencer | 313/448 |

*Primary Examiner*—Maynard R. Wilbur
*Assistant Examiner*—T. M. Blum
*Attorney, Agent, or Firm*—Fitch, Even, Tabin & Luedeka

[57] ABSTRACT

An electron gun system is described for generating a high current collimated beam of electrons for use in a shaped beam cathode ray tube system. The electron gun includes a cathode having an electron emitting surface for generating free electrons, a collimating grid axially spaced from the cathode and having a central aperture, and a control grid axially spaced from the collimating grid and having a central aperture axially aligned with the aperture of the collimating grid. The control grid receives a varying potential for establishing an electric field which is substantially axial over at least a central portion of the electron beam so as to collimate the beam axially. The collimating grid receives a fixed potential relative to the cathode and influences the electric field near the collimating grid and near the outer perimeter of the electron beam so as to form centrally directed field components for directing electrons in the outer portion of the beam toward the central portion of the beam to compensate for space charge effects and to maintain the collimation of the electron beam.

14 Claims, 9 Drawing Figures

CHARACTER LOCATION CIRCUITS
CHARACTER INPUT DEVICE
CHARACTER SELECTION CIRCUITS
VARYING POTENTIAL
FIXED POTENTIAL
9.4" TO SCREEN 16
4.6"
4.9"
.74"

COLLIMATED BEAM ELECTRON GUN SYSTEM FOR SHAPED BEAM CATHODE RAY TUBE

This invention relates to shaped beam cathode ray tube systems and is particularly directed to an improved electron gun system therefor.

Cathode ray tubes of the shaped beam type are used for generating and displaying characters such as alphanumeric characters, line segments of graphs and charts, and similar configurations. In cathode ray tubes of the shaped beam type, an electron beam is shaped as it passes from an electron gun to a target such that the resulting cross section of the shaped beam is of predetermined configuration. At the target which, for example, may be a phosphor coated screen, an area is energized or illuminated by the shaped beam so as to display the predetermined character.

A desired cross sectional configuration is attained by passing the beam through one of a plurality of discrete shaping apertures in an electron-opaque plate or stencil disposed perpendicularly with respect to an initial axial path of the beam. The apertures usually are distributed on the stencil in an ordered array, the electron beam being deflected from its initial axial path to pass through a selected aperture. After passing through the aperture, the beam is redirected into an axial path. The beam is then deflected to a predetermined position on the target by a character location field generated by an electromagnetic deflection yoke or similar means. A shaped beam cathode ray tube finds application in systems where, for example, the tube is used as a display device for displaying a text composed of alphanumeric characters. The text may be entered into the system through a character input device which may include a keyboard if the text is to be entered manually. The character input device may also include a memory system for retaining the input information for a selected duration of time. The character input device drives character selection circuits for generating appropriate currents which are applied to deflection coils for deflecting the electron beam through selected apertures in the stencil. The character input device provides synchronizing signals for synchronizing the blanking or turning off of the beam between characters and indexing the display to the next display point so that the characters are discretely and successively displayed across the screen.

Conventional cathode ray tubes, such as those used in television applications, employ an electron gun which converges its beam to a crossover point almost immediately upon leaving the cathode. This point then serves as the object which is imaged on the screen. Prior art shaped beam tubes also use the type of electron gun which converges its beam to a crossover in the cathode area.

The electron gun system of the present invention utilizes a collimating gun instead of the conventional cross-over gun. A collimating electron gun generates an electron beam which is not immediately focused to a crossover point, but rather is collimated in the region near the cathode so that the electrons flow in a streamlined or parallel flow along an initial axial path in the tube. Such a beam is referred to herein as "collimated" to distinguish it from "crossover" type beams even though the collimated beam is eventually deflected from its initial axial path. The collimated beam may be given a relatively uniform high electron density over a wide cross sectional area for flooding the respective apertures in the stencil. The resulting shaped beam which passes through the stencil can then be focused and deflected onto the screen to provide a bright, uniform image.

Crossover electron guns suffer from undesirable effects which the crossover in the cathode region has on an electron beam. The resulting high current density in the cross-over region and the resultant space charge effects in that region result in distorting influences on the beam. The collimated beam avoids the space charge effects of crossover and can therefore have a higher current density relatively uniformly distributed over at least a central part of the beam cross section.

So-called laminar flow electron guns are known for generating electron beams which are not focused to a point near the cathode. Such electron guns are shown in U.S. Pat. Nos. 3,740,607 and 3,894,261. In each patent, the illustrated electron gun has a specially shaped first grid for shaping an electric field to produce a laminar type electron beam. These customized grids are not commonly found in conventional cathode ray tubes, but must be specially manufactured and are, therefore, necessarily more expensive. Moreover, electron beams generated by these specially shaped grids are not usually particularly suitable for use in shaped beam tubes because of their relatively low currents. A typical shaped beam tube may require a cathode current of from two to three milliamperes to generate bright images. The electron guns described in the above-noted patents are designed for applications requiring only microamperes of cathode current and are, therefore, not useful in shaped beam tubes.

Another problem which renders some prior laminar beam electron guns impractical for use with shaped beam cathode ray tubes is that they have a control or modulating grid which draws current from the electron beam. The more current the control grid draws, the more power dissipated in its control circuitry. If the control circuitry must be able to handle a relatively substantial amount of power, it cannot be switched off and on as rapidly as a control circuit which need handle only very little power. In a shaped beam tube, the electron beam may be on for only one microsecond after which it is off as the directing fields are modified to direct the next selected character to another spot on the display screen in the next 3 microseconds. This fast rate of "writing" requires a control grid and control circuitry which can respond appropriately. Thus, prior art laminar beam guns having control grids which draw beam current are as a practical matter too slow for shaped beam cathode ray tube systems. In part the higher beam intensity for shaped beam tubes is achieved in the present invention by utilizing the first grid nearest the cathode for beam collimating and the next grid for beam modulation or turning the beam on and off, rather than using the first grid for beam modulation as in the prior art.

It is a general object of the invention to provide an improved electron gun system for use in shaped beam cathode ray tube systems. It is a specific object of this invention to provide in a shaped beam cathode ray tube system a low cost electron gun system which generates a high intensity collimated electron beam which can be modulated at the rapid rates required in shaped beam tubes.

The features of the invention which are believed to be novel are set forth with particularity in the appended claims. The invention, together with further objects and advantages thereof, may best be understood, however, by reference to the following description taken in conjunction with the accompanying drawings in which:

Figures 1, 2:
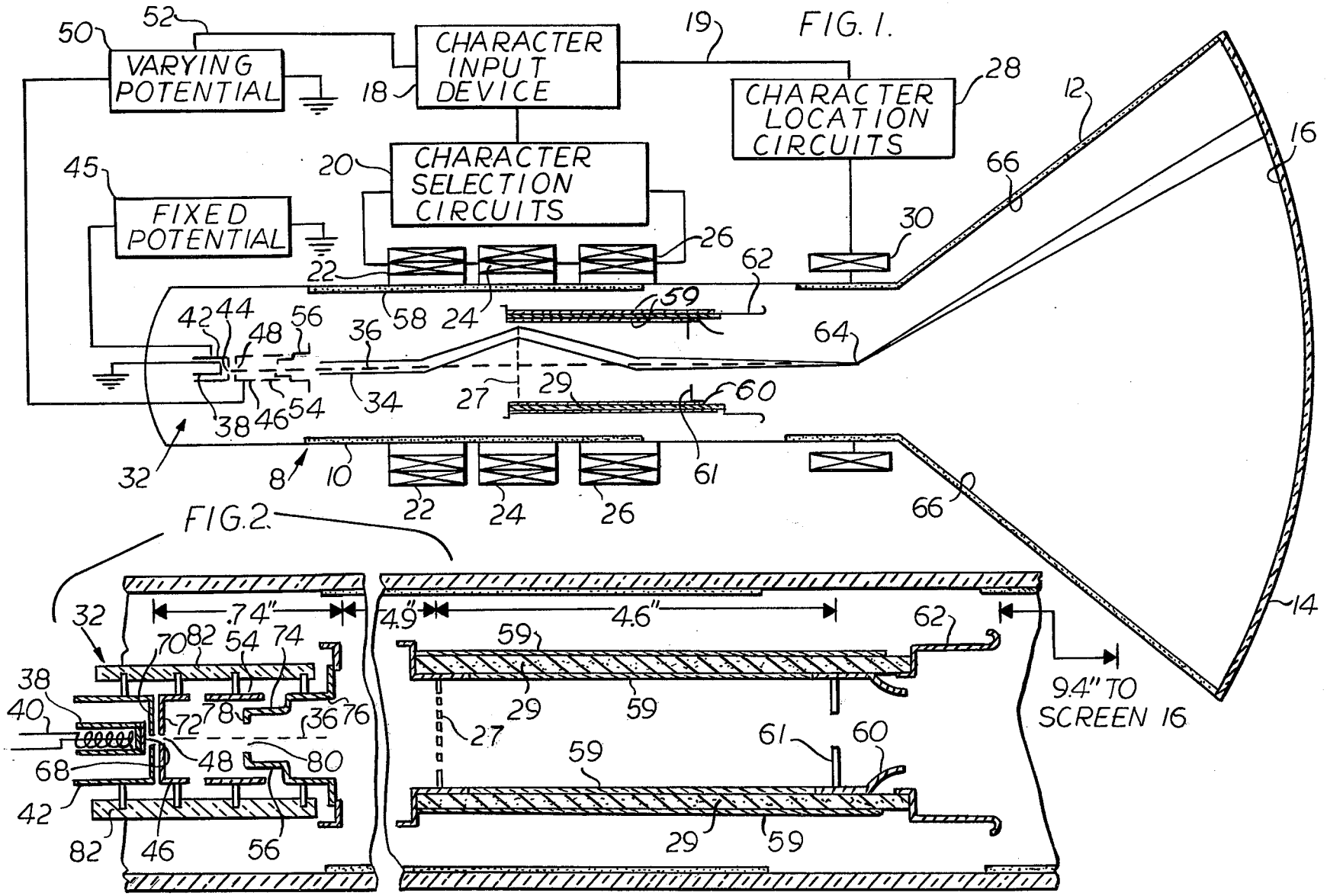
FIG. 1 depicts in cross section a shaped beam cathode ray tube system having an electron gun system according to this invention.
FIG. 2 depicts in cross section the electron gun and other beam shaping electrodes of cathode ray tube shown in FIG. 1.
Figure 4:
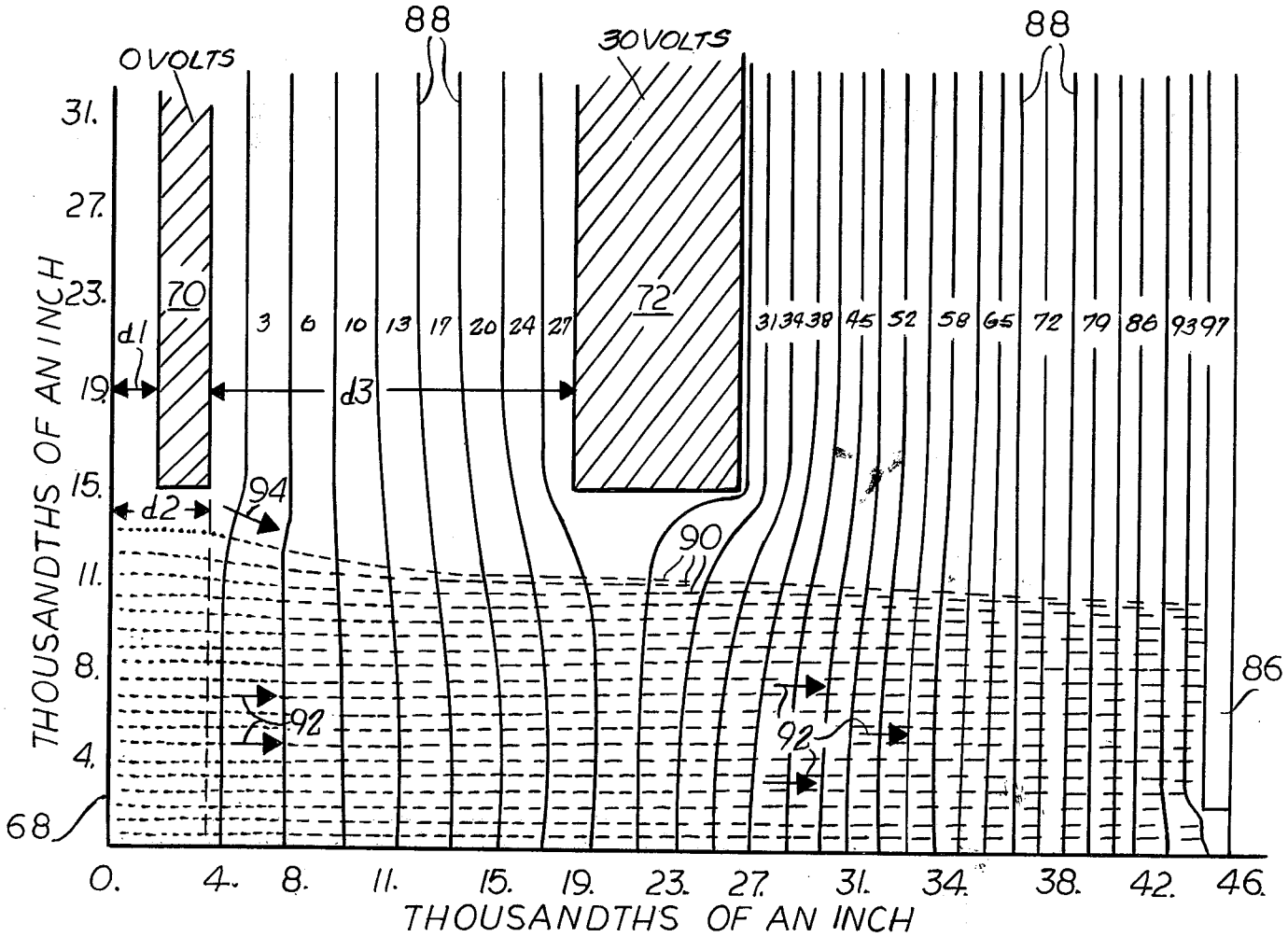
FIG. 4 is a computer generated plot of equipotential lines in an electric field generated by the electron gun shown in FIG. 2 and the trajectories of the electrons accelerated and collimated by such field.
Figure 5:
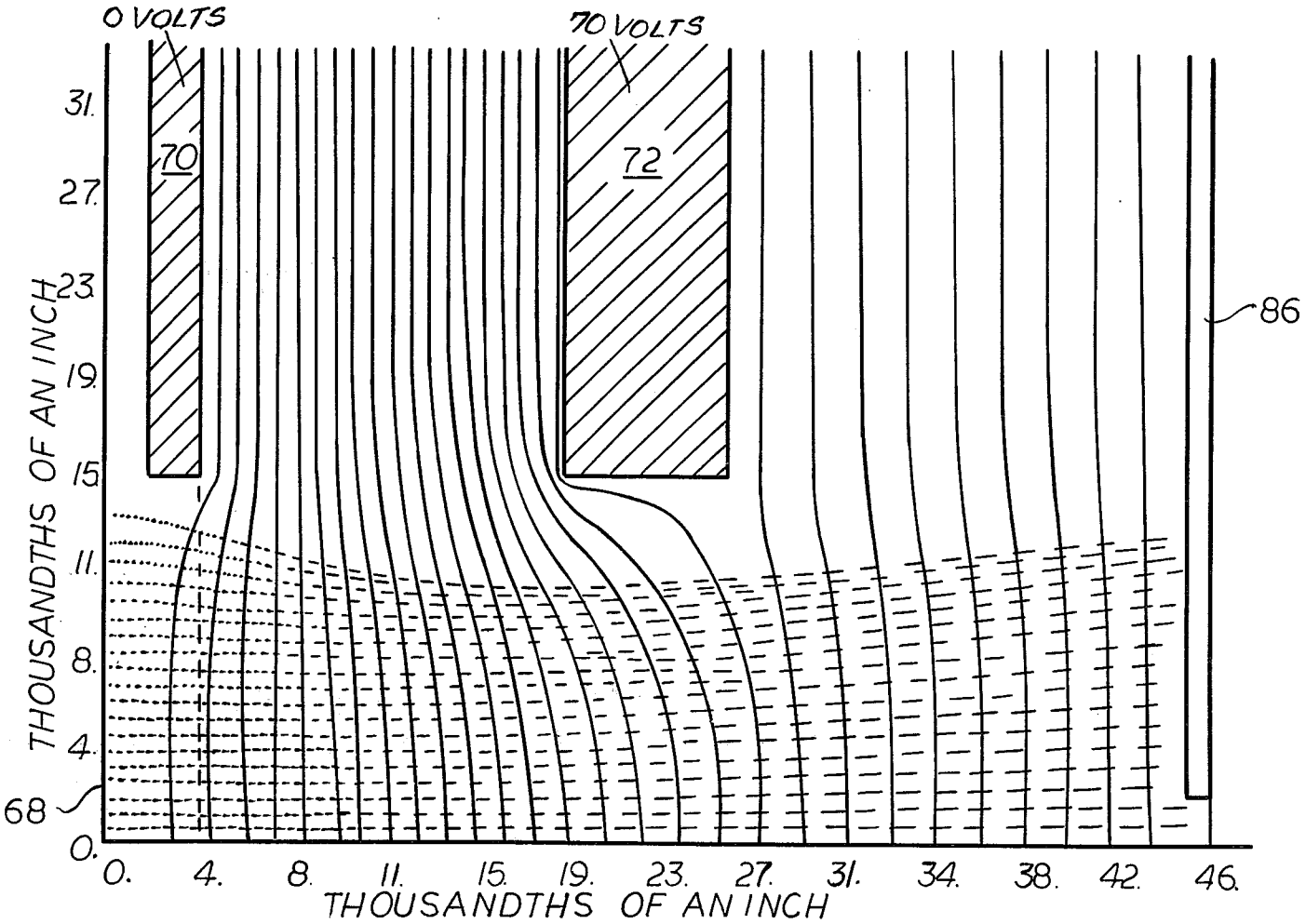
FIG. 5 is a computer generated plot similar to that shown in FIG. 4 but with a different voltage on one of the grids of the electron gun.
Figure 6A:
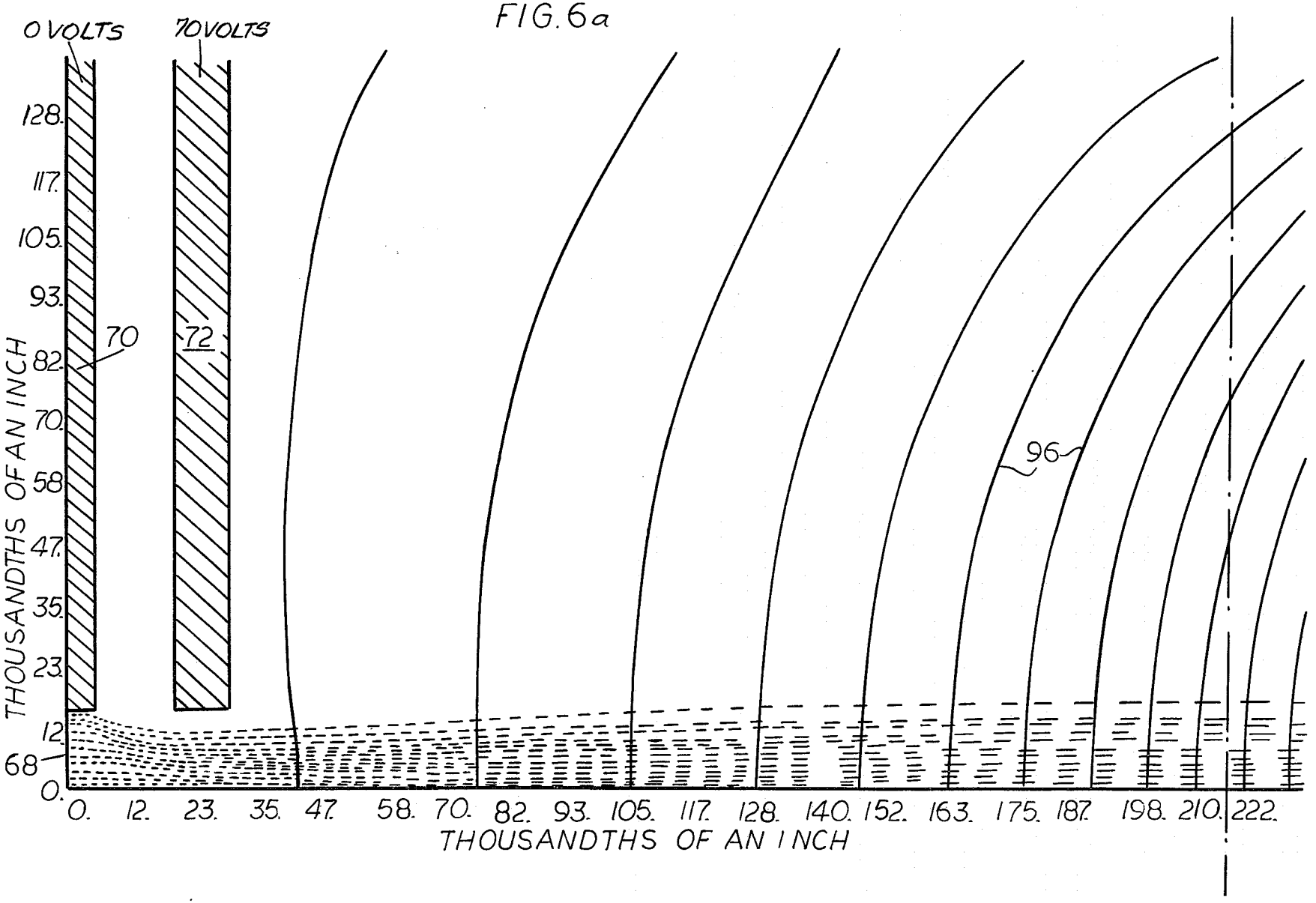
Figure 6B:
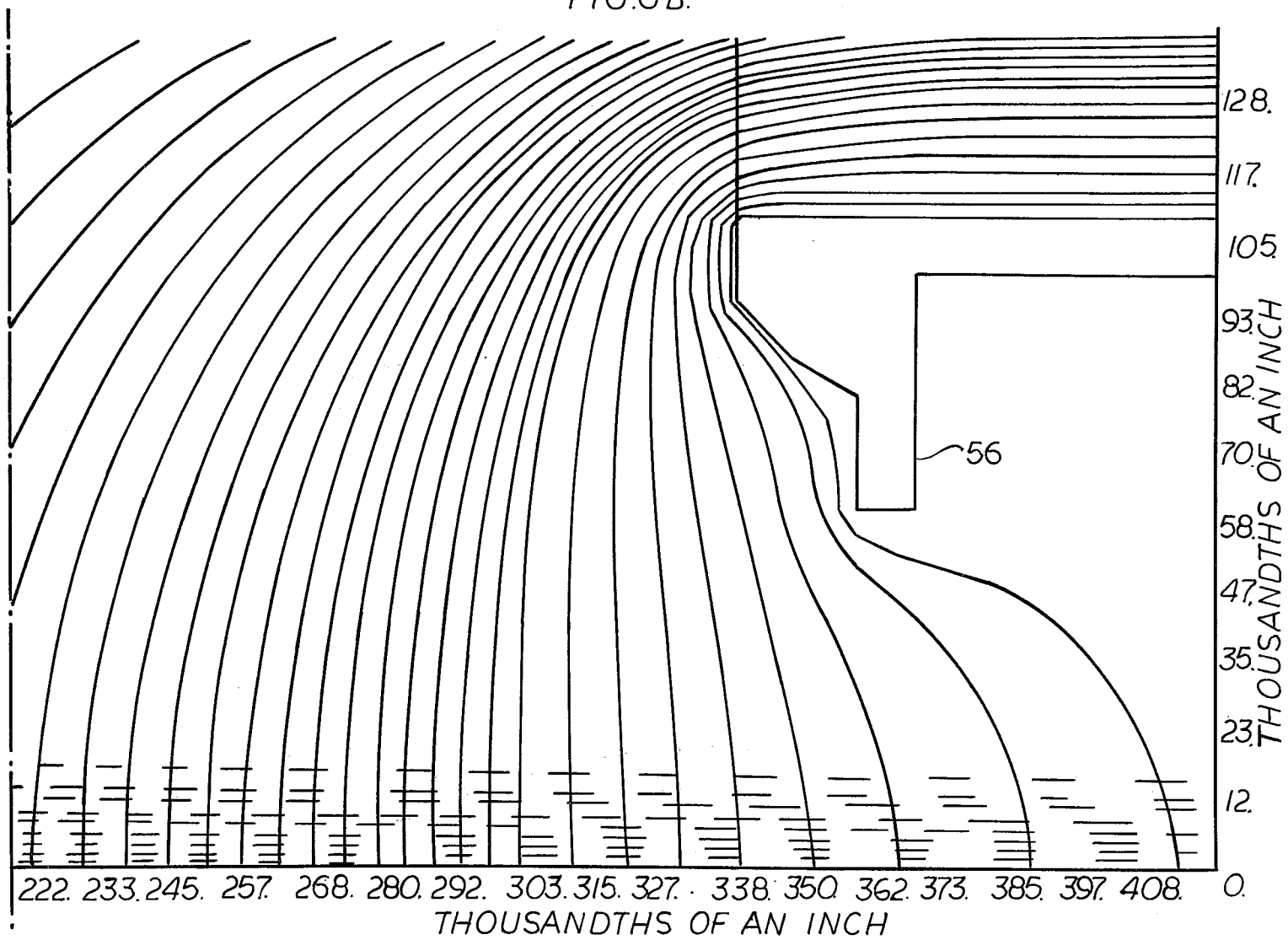
Figure 7:
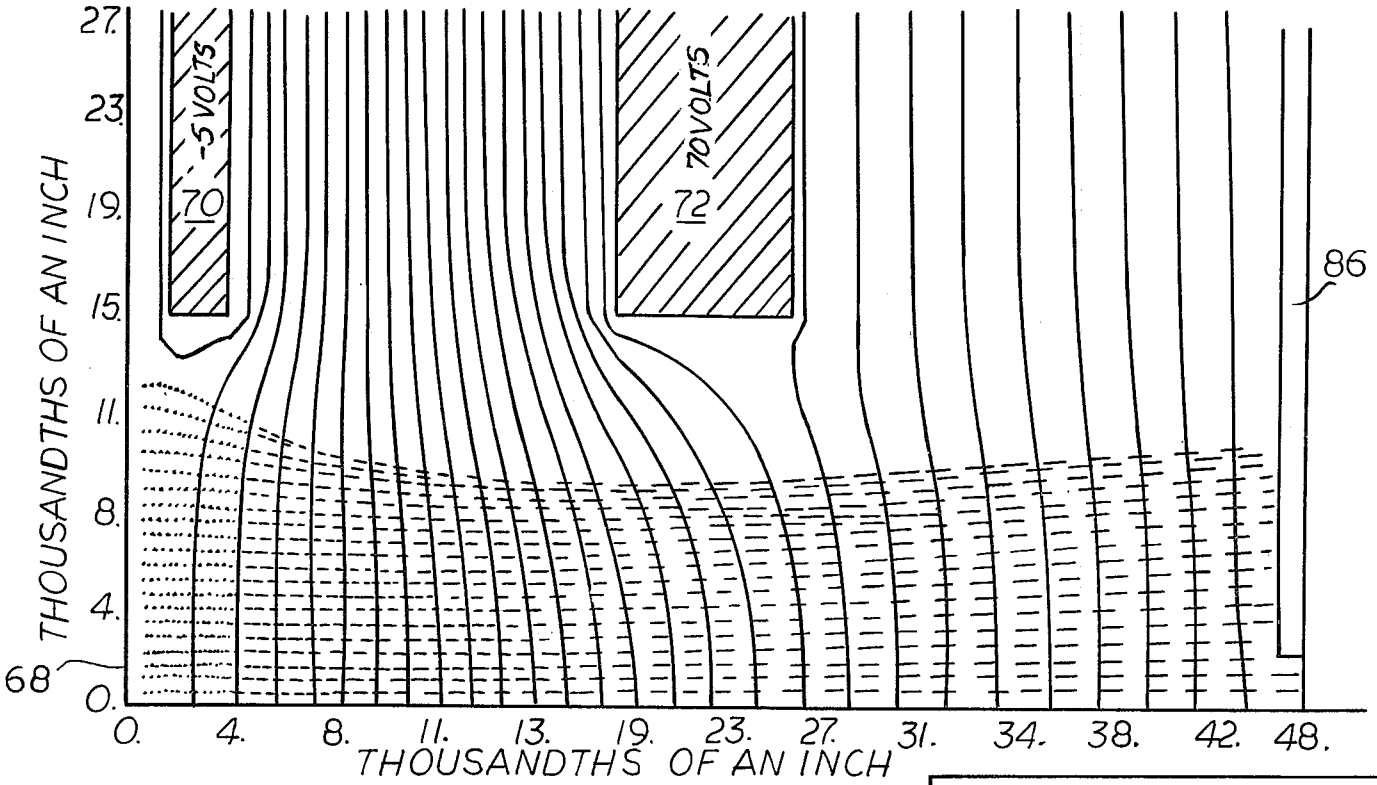
Figure 8:
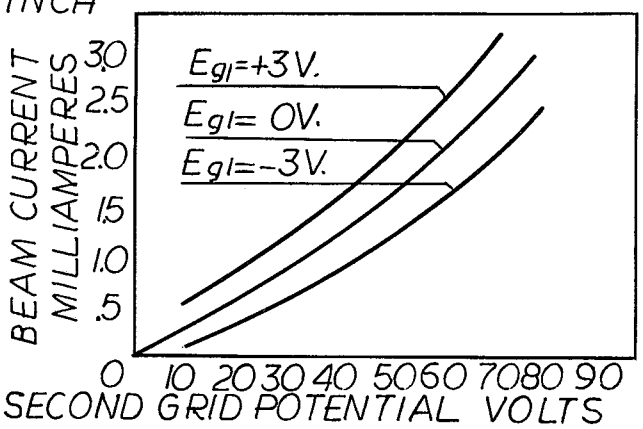

FIGS. 6*a* and 6*b* are computer generated plots of the equipotential lines and electron trajectories conditions similar to those under which FIG. 5 was derived, but over a greater portion of the electron gun, from the cathode to the second anode;

FIG. 7 is a computer generated plot similar to that of FIG. 4 but with different voltages on both grids; and FIG. 8 is a plot of the electron beam current of the electron gun shown in FIG. 2 as a function of the potential on the modulating grid.

A shaped beam cathode ray tube system using an electron gun system constructed according to this invention is shown in FIG. 1. A cathode ray tube 8 has an outer glass envelope which includes a neck portion 10, a conical section 12, and a glass faceplate 14. A light-emitting phosphor screen 16 disposed on the inner surface of faceplate 14 emits light when energized by an electron beam.

As discussed above, a shaped beam tube generates characters for display on a target such as the screen 16. Such tubes may operate either as an input terminal or as an output display. It may be fed directly from a computer or the characters may be generated by operation of a character input device 18. Such a character input device may include a keyboard with a plurality of character keys for selecting respective characters, such as alphanumeric characters, for display upon the screen 16. Also included in device 18 is a memory system so that characters selected for display on the screen 16 will remain displayed for a selected duration and selected number of refresh cycles. The character input device 18 drives character selection circuits illustrated generally at 20 for generating suitable currents to deflect an electron beam so as to generate the selected character. Electromagnetic deflection yokes 22, 24 and 26 receive the currents from the character selection circuits 20 and develop respective magnetic fields for deflecting the beam in a manner to be described below.

Character location circuits 28 are coupled to the character input device 18 via conductor 19 to develop currents for driving a final deflection yoke 30 in synchronism with the character generation to deflect the shaped electron beam to desired respective positions on the screen 16. The screen 16 responds to the incidence of the electron beam by producing light in the configuration of the respective characters.

Located at the extreme end of the neck 10 of the shaped beam tube is an electron gun 32 for generating a collimated beam 34 of electrons along an axial electron beam path 36. The electron gun 32 includes a thermionic cathode 38 having an electron emissive surface for emitting free electrons. A conventional filament heater 40 (FIG. 2) is supplied for heating the cathode 38. Disposed axially forward of and adjacent the cathode 38 is a first grid 42, referred to herein as the collimating electrode. The electrode 42 has a central aperture 44 therein for passing the free electrons emitted by the cathode 38 and is coupled to a source 45 of a fixed potential to bias the electrode 42 at or near the potential of the cathode 38. Situated axially forward of the collimating electrode 42 is a second grid or control electrode 46 for controlling the number of electrons in the electron beam 34. The control electrode 46 also has a central aperture 48 axially aligned with the aperture 44 in the electrode 42. The control electrode 46 receives a varying potential from a source 50 for modulating the intensity of the electron beam. In the illustrated embodiment, the varying potential is in the form of a voltage which alternates between a cut-off level and a conduction level for alternately turning the electron beam 34 off and on. In the illustrated embodiment, the varying potential source 50 is connected to the character input device 18 via conductor 52 so that the off-on potential applied to electrode 46 can be synchronized with the character selection circuits 20 and the character location circuits 28. In this way, the electron beam may be turned off while the field generated by yoke 30 is changing so that the beam strikes only selected portions of the screen 16. Selection of another character is also made while the beam is off.

In order to accelerate the electron beam along its axial path, first and second anodes 54 and 56, disposed axially from electrode 46 receive appropriate acceleration potentials. Specifics of the illustrated electron gun and its method of operation will be described below. Suffice it to say that the electron beam generated by the electron gun 32 is of the collimated type and has a cross section which is generally circular, although other shapes, such as rectangular, may be generated by altering the shapes of apertures 44 and 48 in the modulating and control electrodes. The way in which the electrons within the electron beam are collimated by the electron gun to form a streamlined or collimated electron beam will be described in greater detail below.

The electron beam 34, upon passing through the second anode 56, enters an electric field-free region containing a stencil 27 disposed in the neck of the tube and within the magnetic influence of the field created by deflection yoke 24. The stencil 27 has a plurality of discrete apertures therein shaped in the form of characters for shaping the electron beam cross section accordingly. The stencil intercepts the electron beam and, depending on the size of the beam, forms one or more shaped beams having a cross section corresponding to the cross section of the apertures through which the beams pass. If more than one shaped beam is formed, the unwanted beams may be intercepted in a manner to be described below.

The stencil 27 is mounted on a pair of support rods 29. Rods 29 are of ceramic, for example, and have along their outer surfaces a conductive deposit 59, the function of which is described below. Also mounted on rods 29 is an electrode 60 having a disc shaped portion 61 and an electrode 62. The disc portion 61 intercepts all but the desired shaped beam so as to permit only a selected character to be imaged on the screen 16. Electrode 62 forms part of an electron lens for imaging a character aperture in the stencil 27 on the screen 16. A conductive coating 66 covering the inner portion of the conical section 12 and the forward part of neck portion 10 acts in conjunction with electrode 62 to form a two cylinder electron lens. The lens is focused, in the embodiment, by varying the potential on electrode 62 by means not shown. Electrode 62 receives a focusing potential of approximately 4000 volts and causes the electron beam to crossover in the region of the deflection yoke 30 designated at 64 in order to minimize distortions as the beam is deflected toward the screen 16.

The region in which the crossover occurs is maintained relatively electric field-free by the conductive coating 66 which surrounds the crossover region 64. The conductive coating 66 is electrically connected to the screen 16 and operates at the same potential as the screen, approximately 14,000 volts, for example.

In order to produce the relatively field-free drift region for the transit of the electrons from the electron gun 32 through the stencil 27 to the lens 62, an internal conductive coating 58 is provided on the inner wall of the neck 10, electrically connected by means not shown to the second anode 56, the stencil 27 and the electrode 60. The connection between coating 58 and stencil 27 is made by means of several snubber springs (not shown) which contact coatings 58 and 59. Excess charges which would otherwise collect on stencil 27 and electrodes 60 can drain off through coating 59, the snubber springs and coating 58. The snubber springs also serve to hold rods 29 in place within the neck of the tube.

Since precise magnetic deflection of the electron beam must occur in the region of the stencil 27 deflection of the beam by extraneous electric fields in that region must be minimized. That is the reason this region is made relatively electric field-free. The second anode 56, the internal conductive coating 58, the stencil 27 and the electrode 60 are at substantially the same potential, preferably about 4000 volts, thereby creating the drift region or unipotential region wherein virtually no electrically acceleration, deceleration or focusing occurs.

Upon emerging from the gun 32, the collimated electron beam of this embodiment has a cross-sectional size which is greater than the size of an individual character in the stencil 27. Accordingly, only a central portion of the electron beam will strike and pass through a selected stencil aperture. The remaining outer portion of the beam will be masked either by the stencil body between apertures or by disc portion 61. The collimated but unshaped electron beam leaves the gun 32 and travels through a generally electric field-free region until it comes under the influence of the magnetic field generated by the first deflection yoke 22. At that point, the beam is deflected to a selected character in stencil 27 and floods the selected character with a central portion of the beam. That portion of the electron beam which emerges from the stencil is then redirected from its diverted path back toward its axial path by the magnetic field established by the second yoke 24. In the illustrated configuration, such redirection occurs both before and after the beam passes through the selected aperture in the stencil, since the stencil is at about the midpoint of the field generated by yoke 24. If desired, however, the yoke 24 may be shifted to a position on either side of the stencil 27 to provide all redirection of the beam either before or after it passes through an aperture.

When the redirected beam reaches its original axial path, it then comes under the influence of the magnetic field generated by the third yoke 26 which operates to deflect the electron beam to its initial axial path. With the electron beam now back to its axial path, it becomes focused as it passes through the electrodes 60 and 62, crosses over at 64, and is deflected onto a selected region of screen 16 by the magnetic deflection field of the final yoke 30.

Deflection yokes 22, 24 and 26 are not a part of this invention and will therefore be but briefly described herein. They are more fully described in U.S. Pat. No. 3,473,077, assigned to the assignee of the instant invention. Briefly, the deflection yokes are supported externally of the neck section 10 by means not shown so that yokes 22, 24 and 26, are respectively disposed rearward of, at, and forward of the stencil 27, the rearward and forward yokes 22 and 26 being equally spaced from the center yoke 24. Each deflection yoke 22, 24 and 26 is provided with an X deflection winding and a Y deflection winding, schematically illustrated, as is well-known in the art. Suitable currents supplied to the X and Y windings of each deflection yoke determine the amount of deflection of the electron beam as it passes through the magnetic field established by the respective yokes. Such currents are provided as shown by character selection circuits 20. Although character selection circuits 20 may include separate amplifiers for driving each of the X and Y windings in each yoke, a substantial saving in cost may be achieved by connecting the X windings of the yokes 22, 24 and 26 in series such that they may be driven by a single amplifier. Similarly, the Y windings of the yokes 22, 24, and 26 are also connected in series to be driven by a single amplifier. The X windings in the yokes 22 and 26 are identically wound, whereas the X winding in the yoke 24 is wound oppositely. Similarly, the Y windings in the yokes 22 and 26 are identically wound whereas the Y winding in the yoke 24 is wound oppositely.

The angle through which the beam is deflected by the center yoke 24 is nominally twice the deflection angle imparted by the rearward yoke 22, and is in the opposite direction. Since in series-connected yokes the current is the same in each yoke, the yoke 24 is provided either with twice the number of turns on its coils, or with twice the effective axial length of yoke 22, to give it twice the deflection sensitivity. The field of the yoke 24 is made opposite in direction either by winding its coils in the opposite sense or by crossing the connecting wires between the yoke 22 and the yoke 24. The correction provided to the beam by the center deflection yoke 24 is sufficient to cause the beam to intersect the electron beam path at about the center of forward yoke 26.

Figure 3:
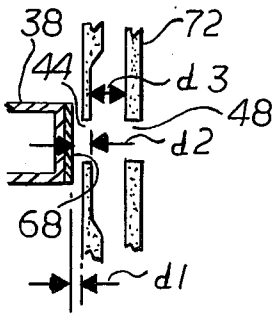
FIG. 3 is an expanded view of various elements of the electron gun shown in FIG. 2.

Turning now to a more detailed discussion of the illustrated electron gun, reference is made to FIGS. 2 and 3 wherein elements corresponding to elements shown in FIG. 1 have the same reference numbers. The electron gun 32 (FIG. 2) is shown with a cathode heater 40 for heating cathode 38 so as to boil electrons off the electron-emitting surface 68 of cathode 38. As shown, emitting surface 68 is planar and substantially normal to the axial electron beam path 36.

The collimating electrode 42 is shown in this embodiment as being cup-shaped and substantially enclosing the cathode 38 except in the region of the aperture 44. The electrode 42 includes a disc-shaped portion 70 which extends substantially parallel to the electron-emitting surface 68 of the cathode. The disc portion 70 is axially spaced from the cathode 38 by a distance *d*1 (FIG. 3) which is approximately 0.002 inch. This distance *d*1 may be increased but should be less than 0.005 inch in order selectively to influence the electric field near the cathode in a way to be described below. In this embodiment, the disc portion 70 of the collimating electrode 42 is spaced as close as practical to the electron-emitting surface 68 without actually touching it. A distance *d*1 much less than 0.002 inch might enable the cathode and electrode 42 to touch each other at least occasionally when the tube is heated or vibrated. Such touching would be undesirable even if both elements are operated at the same potential since the electrode 42 would then act as a heat sink for the cathode and cause the cathode to cool down, thereby undesirably lowering the emission of electrons.

FIG. 3 illustrates how the disc portion 70 of the grid 42 may be ground down or coined near the aperture 44 to reduce the thickness of disc 70 and permit the side of the disc 70 farther from the cathode to be placed closer to the electron-emitting surface 68. In this embodiment, the disc portion 70 is approximately 0.007 inch thick everywhere but near the aperture 44 where it tapers down to approximately 0.002 inch thick. This coining of the disc portion 70 places the side of the disc 70 opposite the cathode at a distance *d*2 from electron-emitting surface 68. Distance *d*2, as shown in FIG. 3, is approximately 0.004 inch and is selected to cause the electrode 42 to direct the electric field in the cathode region so as to assist in the collimation of the electron beam in a manner to be described.

It is noted that the coining of disc portion 70 is solely to reduce the thickness and not to impart to it a special shape. If the entire disc portion 70 of electrode 42 could be made only 0.002 inch thick and remain sufficiently rigid, the coining would be unnecessary.

Referring again to FIG. 2, the control electrode 46 is also shown as being cup-shaped in this embodiment and having a disc portion 72 extending substantially parallel to the electron-emitting surface 68 and having a central aperture 48 axially aligned with the aperture 44 in the collimating electrode 42. The disc portion 72 of the electrode 46 is axially spaced from the coined portion of disc portion 70 by a distance *d*3 (FIG. 3) which, in this embodiment, is approximately 0.015 inch. The distance *d*3 also plays an important role in the collimating function of the electron gun as will also be fully described below.

The apertures 44 and 48 are each circular and approximately 0.031 inch in diameter. The diameter of the aperture 44 operates, in conjunction with the potential applied to the first grid 42, substantially to determine the size of the collimated electron beam, at least in the case where the electron-emitting surface 68 is larger than the aperture 44 as it is in the illustrated embodiment.

The first anode 54 is cylindrical and is axially spaced from the control electrode 46 as shown. The second anode 56 has a pair of coaxial cupped portions 74 and 76 and a disc portion 78 which is substantially normal to the axial electron beam path 36 and which has a circular aperture 80 through which the collimated electron beam passes.

Anode 56 operates at the potential of the drift region, 4,000 volts. Anode 54 operates at a potential intermediate the potential on cathode 38 and 4,000 volts, typically 100 to 300 volts and is adjusted within that range to maximize the collimation of the beam.

All of the electron gun electrodes except for the cathode are supported by a pair of axially extending glass rods 82. The rods 82 are supported within the neck of the tube in a manner well-known in the art.

The electrode 58 is deposited on the inner wall of the neck 10 of the tube 8 and is operated at the same potential as the anode 56 to shield the electron beam from extraneous electric fields.

The stencil 27, electrode 60, and electrode 62 are all axially aligned with the electron gun 32 and are supported by the support members 29 which, in turn, are supported within neck 10 by snubber springs (not shown).

The axial lengths of the elements and the axial distances between them are obviously not drawn to scale in FIG. 2. Therefore, representative values of the more important axial dimensions not shown in FIG. 3 are noted in FIG. 2. Specifically, electron gun 32, from the collimating electrode 42 to the end of the second anode 56 may be 0.74 inch, the distance between the anode 56 and the stencil 27 may be 4.9 inches, the distance between the stencil 27 and the electrode 60 may be 4.6 inches, and the distance between the electrode 62 and the screen 16 may be 9.4 inches. These dimensions are suitable for use in a 6 inch diagonal tube.

Turning now to a discussion of how the collimated electron beam is generated in the illustrated embodiment, reference is made to FIG. 4. FIG. 4 is derived from a computer print-out of the trajectory of electrons emitted by the cathode 38 and equi-potential lines in the area of the gun 32 near the cathode 38, the collimating electrode 42 and the control electrode 46.

The physical structures shown in the plot of FIG. 4 include one half of the electron-emitting surface 68 of the cathode, one half the disc portion 70 of the collimating electrode 42, and one half of the disc portion 72 of the control grid 46. Since the electron gun is symmetrical with respect to its lengthwise axis, the remaining halves of the illustrated elements have not been shown in order to simplify the drawing. It is understood, however, that the electron beam shown in FIG. 4 is only one half of the actual beam. The vertical and horizontal axes of the plot are scaled in thousandths of an inch.

A reference anode surface 86 is shown which is required only for the computer program which generated the plot and which approximates the equipotential line which actually exists at that point along the axis. Surface 86 is not a part of the electron gun and has been shown only to illustrate how the equipotential lines were generated by the program. The generally vertically extending lines 88 are equipotential lines and the generally horizontal dashed lines 90 represent the trajectories of electrons emitted by the cathode surface 68. The length of each dash is representative of the speed of the electrons at that location.

The potentials applied to the various electrodes in FIG. 4 are: zero volts on the electron-emitting surface 68, zero volts on the disc portion 70 of the collimating electrode 42, + 30 volts of the disc portion 72 of the control electrode 46, and + 100 volts on the reference surface 86. The numbers adjacent equipotential lines 88 represent the percentage of the voltage on surface 86 which exists at the respective lines 88.

In order to collimate the electron beam and especially the central portion thereof which floods selected apertures in the stencil 27, the disc portion 72 of the control electrode is situated as shown and given a potential (here, 30 volts) which, in combination with other potentials present, causes the equipotential lines to extend substantially normal to the intended axial path of the electron beam. The electric field is, therefore, substantially axial, particularly in the central portion of the electron beam. The axially directed components of the electric field are represented by arrows 92. These axial components of the electric field accelerate the electrons to move in the direction indicated by arrows 92.

With the electric field near the electron emitting surface 68 being substantially axial, electrons emitted by the surface 68 are initially directed axially along their intended path. As the electrons travel away from the surface 68, they encounter a succession of equipotential lines normal to their direction of movement and the resulting field tends to reinforce their movement along their intended axial path and to collimate them into a uniform beam.

As the collimated electrons approach the disc portion 72, they encounter the equipotential lines adjacent the disc portion 72 which are somewhat curved, with the lines on the side of disc portion 72 nearest the cathode having a curvature which compensates for the curvature of lines on the side of disc portion 72 opposite the cathode. This opposing curvature tends to be self-compensating so that electrons which may tend to be directed somewhat off the axial path are re-directed toward it again by the compensating curvature of the equipotential lines. The curvature of the equipotential lines near the disc portion 72 diminishes with increasing distance from the portion 72 and tends to disappear entirely in the central portion of the electron beam.

The disc portion 72 is shown as being axially spaced from the coined portion of the disc 70 by a distance $d3$ which is approximately 0.015 inch. This distance, $d3$, is chosen so that electrons passing the disc portion 72 will have attained a sufficient kinetic energy such that the passing electrons will be negligibly affected by the curvature of the equipotential lines near the disc portion 72. Thus, with the electrons passing the disc portion 72 at a speed which makes them relatively immune to the curvature of the equipotential lines adjacent the disc portion 72, and with those same equipotential lines becoming generally normal to the axial path of the electrons, particularly near the central portion of the beam, the electrons remain collimated and continue to travel along their axial path without substantial deviation.

Near the disc portion 70 of collimating electrode 42, electrons are emitted from the surface 68 which tend to diffuse outwardly away from the beam due to space charge effects. In order to compensate for the effect of the space charge near the outer perimeter of the beam near the cathode, the disc portion 70 is so positioned and given a fixed potential relative to the cathode as to influence the electric field in that region in a way which re-directs diffusing electrons back toward the central portion of the beam. This effect is accomplished by the bending of the equipotential lines near the disc portion 70 so as to create centrally directed electric field components, illustrated schematically by an arrow 94. These centrally directed components of the field force the outer electrons back toward the central portion of the beam and thereby compensate for the effect of space charge on the outer perimeter of the beam. With the outer perimeter of the beam thus directed toward the central portion of the beam, the outer electrons act as a sheath around the central portion of the beam. This sheath of electrons tends to prevent electrons nearer the central portion of the beam from diffusing due to space charge effects, thus helping to maintain the collimation of the central portion of the electron beam.

The degree to which the equipotential lines near the cathode 38 are bent is a function of the spacing of the electrodes, the size of the aperture 44 in collimating electrode 42 and the strength of the electric field. For example, for a given diameter of aperture 44, moving disc portion 70 away from the cathode (increasing $d1$ or $d2$ or both) increases the degree of bending of the equipotential lines near the cathode 38 and causes the electric field there to have stronger centrally directed components which tend to force diffusing peripheral electrons toward the central portion of the beam to a greater extent. Another method of creating larger centrally directed field components is to bias the disc portion 70 more negatively with respect to the cathode. For the embodiment illustrated above, however, the spacings and aperture sizes indicated in FIG. 3 and a potential on the collimating electrode 42 which is at or near the potential of the cathode 38 appear to provide the required degree of compensation for the space charge effects. Applying a potential to the collimating electrode 42 which is more than 10 volts more negative than the cathode potential tends to cause electrons near the outer perimeter of the beam to be deflected centrally into the central portion of the beam to too great an extent.

Generally, the ratio of the size of aperture 44 in collimating electrode 42 to the axial spacing $d2$ (FIG. 3) between the disc portion 70 and electron emitting surface 68 may be adjusted to vary the strength of the centrally directed components of the electric field near the cathode. This ratio should be at least 5:1 and is dependent on the potential on collimating electrode 42. The ratio in the illustrated embodiment is approximately 8:1 for a potential on collimating electrode 42 which is equal to the potential on cathode 38. A lower ratio tends to give stronger centrally directed field components and a higher ratio tends to give weaker centrally directed field components.

As has been pointed out above, the control electrode 46 receives a varying potential between a cut-off value and a conduction value for alternately turning the electron beam off and on. The conduction value of the potential applied to the control electrode 46 may be varied over a preselected range in order to vary the intensity of the electron beam when it is on and thereby vary the brightness of the displayed image. For the embodiment illustrated herein, a potential within the range of from 20 to 100 volts on the control electrode 46 provides an adequate brightness range without substantially altering the degree of collimation of the electric beam. Varying the potential on the control electrode 46 within the range does cause a charge in the shape of the equipotential lines, particularly near the control electrode 46, but with the control electrode 46 spaced from the collimating electrode 42 as shown, the effect on the trajectory of the electrons is small, particularly, near the central portion of the electron beam.

An illustration of the effect of increasing the potential on the control electrode 46 is shown in FIG. 5 which is the same type of plot as FIG. 4 except that the plot of FIG. 5 was made with a potential of +70 volts on the control electrode 46. The increased potential on the control electrode 46 causes an increased bending of the equipotential lines in the regions near the electrodes, particularly near the control electrode 46. The resultant change in the direction of the electric field near the disc portion 70 of the collimating electrode 42 causes an increasing central deflection of the electrons near the outer perimeter of the beam. Likewise, the resultant change in the direction of the electric field near disc portion 72 of the control electrode 46 causes the electrons near the perimeter of the beam to be deflected somewhat away from the axial path of the beam. However, electrons nearer the central portion of the beam remain reasonably well collimated.

In order to demonstrate more clearly that the central portion of the electron beam remains fairly well collimated, even with a potential of +70 volts on the control electrode 46, reference is now made to FIGS. 6*a* and 6*b* (referred to collectively as FIG. 6) which constitute a computer print-out of electron trajectories and equipotential lines in the electron gun from the cathode region to the region of the second anode 56. The physical structures illustrated in FIGS. 6*a* and 6*b* are the electron emissive surface 68, the disc portion 70 of the collimating electrode 42, the disc portion 72 of the control electrode 46, and part of the second anode 56. The first anode 54 is not shown although its effect has been taken into account in the generation of the plot. The potential supplied to the various electrodes of FIGS. 6*a* and 6*b* are as follows: zero volts on the cathode 38 and on the disc portion 70 of the collimating electrode 42, +70 volts on the disc portion 72 of the control electrode 46, +300 volts on the first anode 54 and +4000 volts on the second anode 56. FIGS. 6*a* and 6*b* indicate that electrons near the periphery of the electron beam generally follow the intended axial path of the beam, but their path varies somewhat from the intended axial path. The central portion of the beam however remains generally well collimated from the cathode all the way to the second anode 56. When potentials of less than +70 volts are applied to the disc portion 72, the electron beam is even better collimated than shown in FIGS. 6*a* and 6*b*.

As has been pointed out above, it is possible to bias the collimating electrode 42 somewhat negative with respect to the cathode and still retain a collimated electron beam. FIG. 7 depicts the same electrode structure shown in the preceding figures but with the disc portion 70 of the collimating electrode 42 biased 5 volts negatively with respect to the cathode 38. The disc portion 72 of the control electrode 46 is at +70 volts with respect to the cathode 38. As shown, the field around disc portion 70 compresses the beam near the region of the cathode 38. Biasing disc portion 70 even more negatively with respect to the cathode 38 can cause electrons in the outer perimeter of the beam to cross over the beam in a manner similar to a conventional "cross-over" electron beam. This effect is avoided if the collimating electrode is biased to no more than 10 volts with respect to the cathode for this embodiment.

Referring now to FIG. 8, a plot of the beam current vs. second grid (control electrode) voltage is shown. FIG. 8 indicates that the electron gun 32 is capable of producing up to 3 milliamperes of beam current. The three plots are for bias potentials on the first grid (collimating electrode) 42 of minus 3 volts, zero volts and plus 3 volts. The amount of beam current provided by this electron gun 32 is substantially greater than that available from the prior art laminar flow electron guns referred to above and is desirable for the proper operation of shaped beam cathode ray tubes.

The electron gun system described herein provides a well combined electron beam for use in shaped beam cathode ray tubes. By selectively positioning the collimating and control electrodes and selectively choosing their operating potentials, an electron gun is provided which uses conventionally shaped electrodes. By avoiding the use of specially shaped electrodes for the electron gun, a lower cost cathode ray tube is possible. In addition, by modulating the second or control electrode rather than the first or collimating electrode as prior art laminar flow guns do, one can vary the intensity of the electron beam without drawing beam current to the control electrode. This effect is illustrated in the various computer plots described above which show that the control electrode draws substantially no current from the electron beam. This permits the control electrode to be switched at the relatively fast rates required in shaped beam tubes. Finally, the electron gun described herein is capable of providing the beam current levels required for high brightness shaped beam tubes.

While the invention has been described in terms of a specific embodiment, it is evident that many alterations, modifications and variations will be apparent to those skilled in the art in light of this disclosure. Accordingly, it is intended to embrace all such alternations, modifications and variations which fall within the spirit and scope of this invention as defined by the appended claims.

What is claimed is:

1. For use in a shaped beam cathode ray tube system in which an electron beam is accelerated along an axial path in a cathode ray tube and directed to an electron beam stencil for shaping the beam into predetermined characters, an electron gun system for generating a high current, collimated beam of electrons directed along an axial path in the tube, said electron gun system comprising:

a cathode having an electron emitting surface for emitting free electrons;

a collimating electrode adjacent said cathode and having a central aperture for passing the free electrons;

means for applying a potential to said collimating electrode substantially fixed relative to the potential of said cathode;

a control electrode axially spaced from said collimating electrode in the direction of the beam and having a central aperture axially aligned with the aperture in said collimating electrode;

means for applying to said control electrode a control potential relative to said cathode which varies alternatively between a cut-off potential and a relatively positive potential acting in conjunction with said fixed potential to establish between the cathode and the aperture in said control electrode an electric field for accelerating the free electrons in a beam along the axial path, said electric field being substantially axial over at least a central portion of the electron beam so as to collimate the electrons at least in a central portion of the beam from the cathode through the aperture in said control electrode.

2. For use in a shaped beam cathode ray tube system in which an electron beam is accelerated along an axial path in a cathode ray tube and directed to an electron beam stencil for shaping the beam into predetermined characters, an electron gun system for generating a high current, collimated beam of electrons directed along an axial path in the tube, said electron gun system comprising:

a cathode having an electron emitting surface for emitting face electrons;

a collimating electrode adjacent said cathode and having a central aperture for passing the free electrons;

means for applying a potential to said collimating electrode substantially fixed relative to the potential of said cathode;

a control electrode axially spaced from said collimating electrode in the direction of the beam and having a central aperture axially aligned with the aperture in said collimating electrode;

means for applying to said control electrode a control potential relative to said cathode which varies alternately between a cut-off potential and a relatively positive potential acting in conjunction with said fixed potential to establish between the cathode and the aperture in said control electrode an electric field for accelerating the free electrons in a beam along the axial path, said electric field being substantially axial over at least a central portion of the electron beam so as to collimate the electrons at least in a central portion of the beam from the cathode through the aperture in said control electrode, said field in the region of said collimating electrode near the outer perimeter of the beam having centrally directed components for directing the electrons in the outer portion of the beam toward the central portion of the beam so as to compensate for the effects of space charge on the beam and thereby maintain the collimation of at least the central portion of the electron beam.

3. An electron gun system as set forth in claim 2 wherein the cathode and the collimating electrode are physically spaced from one another and operated at substantially the same potentials.

4. An electron gun system as set forth in claim 2 wherein the collimating electrode is so shaped, spacially disposed, and biased that it bends the equi-potential lines near the collimating electrode and near the outer perimeter of the beam so as to generate the centrally directed components of the field.

5. An electron gun system as set forth in claim 2 wherein the cathode is a thermionic cathode and its electron emitting surface is substantially normal to the axial path of the electron beam.

6. An electron gun system as set forth in claim 5 wherein the collimating and control electrodes each have a disc portion extending substantially normal to the axial path of the electron beam with the respective central aperture located in said disc portion.

7. An electron gun system as set forth in claim 2 wherein the cathode and the collimating electrode are operated at respective potentials which differ from each other by less than ten volts.

8. An electron gun system as set forth in claim 3 wherein said positive potential applied to the control electrode is within a preselected range, and wherein the control electrode is spaced from the collimating electrode by a distance which is greater than the spacing between the cathode and the collimating electrode and which is selected such that the central portion of the electron beam remains substantially collimated irrespective of variations of said positive potential within said predetermined range.

9. An electron gun system as set forth in claim 2 wherein said cathode and said collimating electrode are axially separated by no more than 0.005 inch.

10. For use in a shaped beam cathode ray tube system in which an electron beam is accelerated along an axial path in a cathode ray tube and directed to an electron beam stencil for shaping the beam into predetermined characters, and then deflected by a character location field to selected regions on a target for displaying the respective characters, an electron gun system for generating a high current, collimated beam of electrons directed along an axial path in the tube, and said electron gun system comprising:

a cathode having a planar electron emitting surface for emitting free electrons and operating at a selected cathode potential;

a collimating electrode having a disc portion extending substantially parallel to the electron emitting surface of the cathode, the disc portion of said collimating electrode being axially spaced from the cathode by less than 0.005 inch and having a central aperture therein for passing the free electrons;

means for applying to said collimating electrode a fixed potential substantially equal to the cathode potential;

a control electrode having a disc portion extending substantially parallel to the electron emitting surface of the cathode and spaced therefrom in the direction of the beam, the disc portion of said control electrode having a central aperture therein axially aligned with the aperture in said collimating electrode;

means for applying to said control electrode a varying potential relative to said cathode which varies alternately between a cut-off potential and a relatively positive potential acting in conjunction with the potential on said collimating electrode to establish between said cathode and the aperture in said control electrode an electric field for accelerating the free electrons in a beam along an axial path, said electric field being substantially axial over a central portion of the electron beam so as to collimate the electrons in at least the central portion of the beam from the cathode through the aperture in said control electrode, the disc portion of said collimating electrode acting to bend the equi-potential lines near the collimating electrode near the outer perimeter of the beam so as to generate centrally directed field components for directing toward the central portion of the beam the electrons in the outer portion of the beam so as to compensate for the effects of the space charge on the beam and thereby maintain the collimation of at least the central portion of the electron beam; and at least one accelerating anode axially spaced from said control electrode in the direction of the beam for accelerating the electrons in said beam.

11. For use in a shaped beam cathode ray tube system, an electron gun system for generating a high current collimated beam of electrons directed along an axial path in a cathode ray tube, said electron gun system comprising:

a cathode having a planar electron emitting surface for emitting free electrons, said surface being substantially normal to and centered on the axial path;

a collimating electrode adjacent said electron emitting surface and having a central aperture centered on said axial path for passing free electrons;

a control electrode axially spaced from said collimating electrode in the direction of the beam and having a central aperture centered on said axial path for passing free electrons;

means for applying a reference potential to said cathode;

means for applying a substantially fixed collimating potential to said collimating electrode;

means for applying a said control electrode a variable control potential for varying the number of electrons which pass through the aperture in said control electrode and for establishing, in conjunction with the potential on said collimating electrode, an electric field between said emitting surface and said control electrode for accelerating the free electrons in a beam along the axial path, said field being substantially axial over at least a central portion of the aperture in the collimating electrode so as to accelerate the electrons in the center of the beam in an axial direction and centrally directed in the region near the outer perimeter of the aperture in the collimating electrode so as to direct the electrons near the periphery of the beam toward the central portion of the beam to compensate for the effects of space charge on the beam and maintain the collimation of the beam.

12. For use in a shaped beam cathode ray tube system, an electron gun system for generating a high current collimated beam of electrons directed along an axial path in a cathode ray tube, said electron gun system comprising:

a cathode having a planar electron emitting surface for emitting free electrons, said surface being substantially normal to and centered on the axial path;

a collimating electrode adjacent and axially spaced from said electron emitting surface and having a central aperture in a disc shaped portion for passing free electrons, said disc shaped portion being substantially normal to the axial path and spaced from said planar surface along the axial path and said central aperture being centered on the axial path;

a control electrode axially spaced from said collimating electrode and having a central aperture in a disc shaped portion for passing free electrons, said disc shaped portion being substantially normal to the axial path and spaced from said disc shaped portion of said collimating electrode in the direction of the axial path and said central aperture being centered on the axial path;

means for applying a reference potential to said cathode, means for applying a substantially fixed collimating potential to said collimating electrode;

means for applying to said control electrode a variable control potential for varying the number of electrons which pass through the aperture in said control electrode and for establishing, in conjunction with the potential on said collimating electrode, an electric field between said emitting surface and the plane of said disc shaped portion of said control electrode for accelerating the free electrons in a beam along the axial path, said field being substantially axial over at least a central portion of the aperture in the collimating electrode so as to accelerate the electrons in the center of the beam in an axial direction and centrally directed in the region near the outer perimeter of the aperture in the collimating electrode so as to direct the electrons near the periphery of the beam toward the central portion of the beam to compensate for the effects of space charge on the beam and maintain the collimation of the beam.

13. An electron gun system as set forth in claim 12 wherein the aperture in the collimating electrode is circular and has a diameter at least five times the axial distance from the emitting surface to the side of the disc shaped portion of the collimating electrode farther from the emitting surface.

14. For use in a shaped beam cathode ray tube system, an electron gun system for generating a high current, collimated beam of electrons directed along an axial path in a cathode ray tube, said electron gun system comprising:

a cathode having a substantially planar electron emitting surface for emitting free electrons, said surface being substantially normal to and centered on the axial path;

means for applying a reference potential to said cathode;

a collimating electrode adjacent and spaced from said cathode and having a disc shaped portion with a central aperture therein for passing free electrons, said disc shaped portion being substantially normal to the axial path and spaced from said planar surface in the direction of the axial path and said central aperture being centered on the axial path;

means for applying to said collimating electrode a fixed potential substantially equal to the reference potential;

means for establishing an axial electric field for accelerating the free electrons along the axial path, said collimating electrode acting in conjunction with said means for establishing an axial electric field to establish centrally directed components of the field in the region of said collimating electrode near the outer perimeter of the beam for directing electrons in the outer portion of the beam toward a central portion of the beam so as to compensate for the effects of space charge on the beam and thereby maintain the collimation of at least the central portion of the beam.

* * * * *

UNITED STATES PATENT AND TRADEMARK OFFICE

CERTIFICATE OF CORRECTION

PATENT NO. : 4,032,815

DATED : June 28, 1977

INVENTOR(S) : Dan Joseph Haflinger

It is certified that error appears in the above-identified patent and that said Letters Patent are hereby corrected as shown below:

Col. 12, line 13 "combined" should be --collimated--.

Col. 12, lines 63-64
Claim 1 "alternatively" should be --alternately--.

Col. 13, line 16
Claim 2 "emitting face electrons" should be --emitting free electrons--.

Col. 14, line 61
Claim 10 "electrode near" should be --electrode and near--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*